United States Patent [19]

DeSimone

[11] 4,113,645

[45] Sep. 12, 1978

[54] BLEACH COMPOSITIONS CONTAINING PERFUME OILS

[75] Inventor: Robert Santora DeSimone, Middletown, N.Y.

[73] Assignee: Polak's Frutal Works, Inc., Middletown, N.Y.

[21] Appl. No.: 819,517

[22] Filed: Jul. 26, 1977

[51] Int. Cl.[2] ..... C11D 3/395; C11D 7/54; C11D 9/44

[52] U.S. Cl. ..... 252/187 H; 8/108 A; 252/95; 252/98; 252/102

[58] Field of Search ..... 252/187 H, 522, 95, 252/98, 99, 102; 8/108 R, 108 A

[56] References Cited

U.S. PATENT DOCUMENTS

| | | | |
|---|---|---|---|
| 3,684,722 | 8/1972 | Hynam et al. | 252/187 H |
| 3,749,673 | 7/1973 | Jones et al. | 252/99 |
| 3,876,551 | 4/1975 | Laufer et al. | 252/98 |
| 4,045,358 | 8/1977 | Ramachandran | 252/102 |

*Primary Examiner*—Benjamin R. Padgett
*Assistant Examiner*—Irwin Gluck
*Attorney, Agent, or Firm*—William S. Alexander

[57] ABSTRACT

An improvement in perfumed bleach solutions which comprises employing a quaternary ammonium salt as an inert dispersing agent for the perfume oil.

5 Claims, No Drawings

BLEACH COMPOSITIONS CONTAINING PERFUME OILS

This invention relates to the preparation of bleach solutions containing perfume oils to mask the unpleasant chlorine odor which is characteristic of such solutions.

The problem associated with the perfuming of an alkali metal hypochlorite bleach solution is a two-part problem. First, such bleach solutions are aqueous systems, and since most fragrance compositions are not soluble in aqueous systems, an appropriate surfactant must be found for dispersing the perfume in the bleach to form a stable emulsion. The surfactant must be one which is unaffected or substantially unaffected by the strong oxidizing and alkali action of the bleach. Second, perfume oils or perfume compositions must be used which likewise are impervious to the oxidizing action of the bleach.

If either the surfactant or the perfume is unstable in the presence of the alkali metal hypochlorite, the effect of the perfume will be lost. A more serious problem, however, is that the alkali metal hypochlorite will be consumed by reaction with the additive and thus the strength of the solution will be lowered, rendering it less effective for its intended use as a household bleach or disinfectant.

The concept of a perfumed bleach composition has been advanced previously. For example, U.S. Pat. No. 3,684,722 teaches that an alkali hypochlorite bleach solution thickened with a mixture of an alkali metal soap and an amine oxide or a long chain substituted betaine can be perfumed, but that the addition of perfume leads to a reduction in stability of the thickened solution. U.S. Pat. No. 3,876,551 teaches preparation of similar compositions based on amine oxides but without the alkali metal soap. Omission of the soap is said to be desirable in order that perfume oils having "clean fresh", "floral", "woody", "musk" or "citrusy" odors can function properly.

Neither of the cited references, however, appears to provide a solution to the problem of long term stability. There is no suggestion that the bleach is substantially undiminished in strength or that the fragrance characteristics of the perfume oils are unaltered upon long term storage. It is an object of this invention to provide perfumed hypochlorite bleach compositions which are stable over relatively long periods of time.

It is a further object of this invention to provide stable perfumed bleach compositions having a variety of odor types.

It is yet another object of this invention to provide surfactants capable of dispersing a perfume oil in a hypochlorite bleach solution, which surfactants are inert to the oxidizing action of the bleach over long periods of storage time.

These and other objects of the invention are accomplished by dispersing a perfume oil in an aqueous solution of an alkali metal hypochlorite using, as a dispersant, a quaternary ammonium compound of the general formula

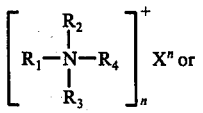

$X^n$ or

-continued

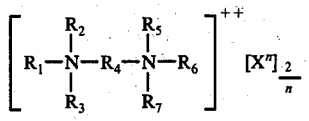

where $R_1$ is an alkyl or aromatic group containing from about 1 to 20 carbon atoms, $R_2$ through $R_7$ are selected from the group consisting of alkyl and aromatic groups containing about 1 to 14 carbon atoms, cycloalkyl groups containing about 5 to 18 carbon atoms, alkaryl groups containing from 7 to 10 carbon atoms, and pyridyl groups, and X is selected from the group consisting of fluoride, chloride, nitrate, sulfate, methyl sulfate, carbonate, sulfonate, chlorate and hydroxide and *n* is either 1 or 2 and is equal to the valence of X.

Typical quaternary ammonium salts useful in the bleach compositions of this invention are hexadecyl trimethyl ammonium chloride, dodecyl trimethyl ammonium chloride, pentadecyl triethyl ammonium chloride, dimethyl stearyl benzyl ammonium chloride, tetradecyl trimethyl ammonium chloride, hexadecyl trimethyl ammonium chloride, and mixtures of these materials. Two preferred quaternary compounds are hexadecyl trimethyl ammonium chloride and dodecyl trimethyl ammonium chloride.

It will be apparent that the perfume oils suitable for use in this invention are those materials which are resistant to the oxidative effects of the bleach or to the alkali action of the alkali metal hypochlorite solution. As employed herein, the term "perfume" or "perfume oil" is intended to include both individual, unblended compounds and blended compositions comprised of a number of specific, identifiable chemical compounds. The preferred classes of fragrance ingredients meeting these requirements are such materials as aromatic heterocyclic nitrogen compounds such as quinolines, pyridines and pyrazines, aliphatic or aromatic acetals, aliphatic or aromatic ethers, aliphatic or aromatic nitriles, tertiary alcohols, and cyclic oxides. Obviously, not every compound within these classes is a useful perfume oil, but any which are otherwise useful and which do not contain substituent groups which are sensitive to alkali metal hypochlorite or to alkali are useful. Substituent groups which are sensitive and which cannot be present are such groups as active methylene groups adjacent to an aromatic ring, esters, C-C double bonds, ketones or aldehydes with enolizable hydrogens, primary or secondary alcohols, and free phenolic hydroxyls.

Among specific perfume oils found stable upon long term storage in contact with liquid alkali metal hypochlorite solutions are 1,8-cineole, 2-isobutyl quinoline, 2-hexyl pyridine, dihydro-8-terpineol, tetrahydrolinalool, paracresyl methyl ether, heptanal diethyl acetal, beta-naphthyl ethyl ether, diphenyl oxide, cedrol, diphenyl ketone, dihydroanethole, acetaldehyde ethyl-betaphenyl ethyl acetal, resorcinol dimethyl ether, diphenyl oxide, tertiary amyl cymene, dimethyl phenyl carbinol, 2-ethyl-3,5-dimethyl pyrazine, 1,3,4,6,7,8-hexahydro-4,6,6,7,8,8-hexamethyl cyclopenta-gamma-2-benzopyran and methyl phenyl ethyl ether.

A typical alkali metal hypochlorite solution employed as a household bleach contains about 5% of sodium hypochlorite. Solutions varying from about 1 to 15% hypochlorite can be used, however. Any of the alkali metal hypochlorites can be used; sodium hypochlorite is preferred.

The amount of quaternary ammonium salt required to disperse the perfume oil in the aqueous bleach solution is between about 0.025 and 1% based on the weight of alkali metal hypochlorite solution. While the precise amount in any instance varies, depending upon the amount and type of perfume oil used and the type of dispersion desired, as a rule of thumb, it is usually found that the amount of dispersant employed is no greater than about three times the weight of perfume oil employed.

The amount of perfume oil added to the bleach solution depends upon the type of oil used and the strength or odor effect desired. Since most perfume oils are relatively expensive as compared to the market price of the bleach solution, the upper limit of perfume oil for economic reasons can usually not exceed about 0.5% based on the weight of the bleach solution. Normally, the amount is between about 0.02 and 0.3% and preferably between about 0.05 and 0.15%.

The following examples illustrate the invention but are not intended to be limiting. Parts and percentages are by weight unless otherwise specified.

EXAMPLE 1

A perfume was compounded in the following proportions:

| | Parts |
|---|---|
| Diphenyl oxide | 140 |
| Cedryl methyl ether | 10 |
| Tetrahydrolinalool | 100 |
| Acetaldehyde ethyl, beta-phenyl ethyl acetal | 30 |
| 1,8-Cineole | 200 |
| Tetrahydromuguol (IFF Register) | 50 |
| Acetaldehyde methyl ethyl acetal | 10 |
| 1,1-Diethoxy heptane | 10 |
| Isobutanal diethyl acetal | 220 |
| Phenyl acetaldehyde dimethyl acetal | 10 |
| Hydrotropic aldehyde dimethyl acetal | 10 |
| 2-Isobutyl quinoline | 5 |
| Dihydroterpinyl acetate | 10 |
| Resorcinol dimethyl acetal | 5 |

This perfume was added with shaking at 0.1% concentration to commercial 5.1% sodium hypochlorite bleach solution containing 0.3% of a 29% aqueous solution of hexadecyl trimethyl ammonium chloride (Arquad 16-29 -Armak Industrial Chemicals Division of Akzona, Inc.). After 14 months of storage at room temperature shielded from light, the mixture still possessed a strong odor of the original perfume quality. A sample of the original unperfumed bleach showed 3.7% hypochlorite (72.5% of original) after the 14-month storage period, while the perfumed bleach sample showed 2.7% sodium hypochlorite (53% of original).

EXAMPLE 2

Three perfumes containing various proportions of:
Beta-naphthyl ethyl ether
Tetrahydrolinalool
Paracresyl methyl ether
Diphenyl oxide Acetaldehyde ethyl - beta-phenyl ethyl acetal were added, with shaking, separately at 0.05% concentration to three separate portions of liquid bleach, which contained 0.05% hexadecyl trimethyl ammonium chloride and placed in an oven at 55° C. After 72 hours in the oven at 55° C., all samples still retained some fragrance.

EXAMPLE 3

The following materials were combined (3 drops) with 50 ml. of commercial 5.1% sodium hypochlorite solution and 9 drops of 29% hexadecyl trimethyl ammonium chloride solution were added, with shaking, to give a dispersion. Periodic observations were made, as shown below, after the solution was allowed to stand at ambient temperature shielded from light:

| Compound | Comments |
|---|---|
| Fragrance from Example 2 | 24 days, odor still strong<br>3 months, odor still present |
| Dihydroanethole | 3 months, odor still strong |
| Resorcinol dimethyl ether | 3 months, odor still present |
| Phenyl acetaldehyde dimethyl acetate | 3 months, odor still present |
| Isobutyl quinoline | 3 months, odor strong |
| 1,1-Diethoxyheptane | 3 months, some odor still present |
| Isobutanal diethyl acetal | 3 weeks, odor strong<br>3 months, little odor |
| Dihydroterpinyl acetate | 3 weeks, odor still strong<br>3 months, odor somewhat diminished |

EXAMPLE 4

Three fragrances were made up of the following ingredients:

| | Fragrance | | |
|---|---|---|---|
| | #1 | #2 | #3 |
| Eucalyptus oil (1,8-cineole) | 800 | 900 | 930 |
| Cedryl methyl ether | 50 | 60 | 50 |
| Dihydroanethole | 10 | 40 | 19 |
| Tetrahydrolinalool | 140 | 0 | 0 |
| Tetrabutyl quinoline | 0 | 0 | 1 |
| Total parts | 1000 | 1000 | 1000 |

Each fragrance was added to commercial 5.1% sodium hypochlorite liquid bleach at 0.1% concentration in three separate 50-ml. portions, which contained 0.05%, 0.3%, and 0.15%, respectively, of 29% hexadecyl trimethyl ammonium chloride solution. All solutions were virtually clear upon mixing of the ingredients. Periodic observations were made on the samples as shown below.

| | % Surfactant | Observations | | | |
|---|---|---|---|---|---|
| | | 2 Weeks | 2 Months | 3 Months | 6-½ Months |
| Fragrance I | 0.05 | Slightly hazy, odor strong | Slightly hazy, odor strong | Slightly hazy, odor strong | Clear, odor good, slight ppt. on bottom |
| | 0.15 | Slightly hazy, odor strong | Slightly hazy, odor strong | Slightly hazy, odor strong | Clear, odor good, slightly hazy |
| | 0.30 | Slightly hazy, odor strong | Slightly hazy, odor strong | Slightly hazy, odor strong | Clear, odor strong |
| Fragrance II | 0.05 | Clear, odor strong | Clear, odor strong | Clear, odor strong | Clear, odor good, slight ppt. on |

-continued

| | % Surfactant | Observations 2 Weeks | 2 Months | 3 Months | 6-½ Months |
|---|---|---|---|---|---|
| | | | | | bottom |
| | 0.15 | Clear, odor strong | Clear, odor strong | Clear, odor strong | Clear, odor good, slightly hazy |
| | 0.30 | Clear, odor strong | Clear, odor strong | Clear, odor strong | Clear, odor strong |
| Fragrance III | 0.05 | Clear, odor strong | Clear, odor strong | Clear, odor strong | Clear, odor strong, slight ppt. on bottom |
| | 0.15 | Clear, odor strong | Clear, odor strong | Clear, odor strong | Clear, odor strong, slightly hazy |
| | 0.30 | Clear, odor strong | Clear, odor strong | Clear, odor strong | Clear, odor strong |

EXAMPLE 5

A fragrance formulated as shown below:

| | | |
|---|---|---|
| 1,8-Cineole | 930 | parts |
| Cedryl methyl ether | 50 | parts |
| Dihydroanethole | 19 | parts |
| 2-Isobutyl quinoline | 1 | part |

was added at 0.05% to 5.0% aqueous sodium hypochlorite solution containing 0.2% hexadecyl trimethyl ammonium chloride and the mixture was stirred until homogeneous. After 6½ months' storage at ambient temperature, shielded from light, the mixture was found somewhat turbid, while the fragrance was strong.

EXAMPLE 6

A fragrance, formulated as in Example 5, was added at 0.2% to two portions of 5.1% commercial sodium hypochlorite solution, containing 0.2% and 0.4%, respectively, of hexadecyl trimethyl ammonium chloride. The solution containing 0.2% quaternary was slightly turbid initially, after mixing, while the one containing 0.4% was clear. After three months, at ambient storage conditions, the solution containing 0.2% quaternary was hazy with a strong odor of perfume still present, while the 0.4% solution was opaque, but still possessing a strong fragrance aroma.

EXAMPLE 7

A mixture of 0.05% fragrance, formulated as in Example 5, and 0.2% hexadecyl trimethyl ammonium chloride in 5.1% sodium hypochlorite solution was found clear after initial mixing. After six weeks, some gelatinous precipitate was present, with the perfume odor quite strong. After four months of storage, under ambient conditions, shielded from light, the solution was turbid, the odor satisfactory.

EXAMPLE 8

(a) A solution of 3 drops of diphenyl methane and 9 drops of a 30% aqueous solution of hexadecyl trimethyl ammonium chloride in 25 ml. of 5.1% sodium hypochlorite was shaken, to aid dispersion, and stored for 4 months at ambient temperature, at which point the odor of the diphenyl methane was absent.

(b) A solution of 3 drops of a mixture of 2,6-dimethyl-2-octanol and tetrahydrolinalool (mixture known commercially as Tetrahydromuguol, IFF Register) and 9 drops of a 20% aqueous solution of hexadecyl trimethyl ammonium chloride was stored, at ambient temperature, for 4 months, whereupon the odor of the fragrance material was still strong and the hypochlorite strength of the solution tested out at 4.35% hypochlorite. The original 5.1% hypochlorite solution, after the same four-month period, tested at 4.85% hypochlorite.

In a similar manner, the following fragrance materials were storage-tested with results as tabulated below.

| Material | Storage Period | Odor | % Hypochlorite Remaining |
|---|---|---|---|
| 1,4-Cineole | 4 months | Nil | — |
| 1,8-Cineole | 4 months | Strong | — |
| Acetaldehyde ethyl methyl acetal | 4 months | Strong | — |
| Beta-phenyl ethyl methyl ether | 4 months | Strong | — |
| Cedryl methyl ether | 4 months | Strong | 4.05% |
| | 6 months | Strong | — |
| Diphenyl oxide | 4 months | Strong | — |
| Perfume from Example 1 | 3 months | Strong | 4.55% |
| Perfume from Example 1 | 4 months | Strong | 4.10% |
| 2-Isobutyl Quinoline | 4 months | Strong | 4.05% |
| Dihydroanethole | 4 months | Strong | 4.35% |
| Ortho-methoxybenzyl ether | 4 months | Strong | — |
| 1,1-Diethoxy heptane | 4 months | Moderate | — |

EXAMPLE 9

A fragrance formulated as in Example 5 was added at 0.05% level to 5.0% aqueous sodium hypochlorite solution containing 0.2% hexadecyl trimethyl ammonium chloride (Variquat E228 - Ashland Chemical Company) and the mixture stirred until homogeneous. After 6½ months' storage at ambient temperature, shielded from light, the mixture was found somewhat turbid, but the fragrance persisted in strength.

EXAMPLE 10

A fragrance formulated as in Example 5 was added at 0.05% level to 5.0% aqueous sodium hypochlorite solution containing 0.6% of a mixture of 5% octyl, 6% decyl, 51% dodecyl, 19% tetradecyl, 9% hexadecyl and 5% octadecyl trimethyl ammonium chlorides (Arquad C-33 - Armak Industrial Chemicals Division of Akzona, Inc.) and the mixture stirred until homogeneous. After 6½ months of storage at ambient temperature, shielded from light, the perfume in the mixture had retained its odor potency.

What I claim and desire to protect by Letters Patent is:

1. In an alkali metal hypochlorite bleach solution containing a perfume oil to mask the chlorine odor thereof and a dispersant for said perfume oil, the improvement which comprises said dispersant being at least one quaternary ammonium compound having the structural formula

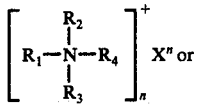

$X^n$ or

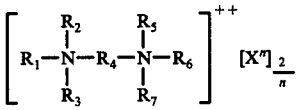

where $R_1$ is an alkyl or aromatic group containing from about 1 to 20 carbon atoms, $R_2$ through $R_7$ are selected from the group consisting of alkyl and aromatic groups containing about 1 to 14 carbon atoms, cycloalkyl groups containing about 5 to 18 carbon atoms, alkaryl groups containing from 7 to 10 carbon atoms, and pyridyl groups and X is selected from the group consisting of fluoride, chloride, nitrate, sulfate, methyl sulfate, carbonate, sulfonate, chlorate and hydroxide, and $n$ is either 1 or 2 and is equal to the valence of X.

2. The bleach solution of claim 1 wherein the perfume oil is present in an amount between about 0.02 and 0.5% and the quaternary ammonium compound is present in an amount between about 0.025 and 1%.

3. The bleach solution of claim 2 wherein the alkali metal hypochlorite is sodium hypochlorite.

4. The bleach solution of claim 3 wherein the quaternary ammonium compound comprises hexadecyl trimethyl ammonium chloride.

5. The bleach solution of claim 3 wherein the quaternary ammonium compound comprises dodecyl trimethyl ammonium chloride.

* * * * *